US006599082B2

(12) United States Patent
Lawrence

(10) Patent No.: US 6,599,082 B2
(45) Date of Patent: Jul. 29, 2003

(54) INTERMODAL TRANSPORT SYSTEM FOR FREIGHT

(76) Inventor: James Lawrence, 220 Buccaneer Dr., Port Saint Jo, FL (US) 32456

( * ) Notice: Subject to any disclaimer, the term of this patent is extended or adjusted under 35 U.S.C. 154(b) by 2 days.

(21) Appl. No.: 09/859,810

(22) Filed: May 17, 2001

(65) Prior Publication Data

US 2002/0172571 A1 Nov. 21, 2002

(51) Int. Cl.[7] ..... B60P 3/42; B60P 3/08
(52) U.S. Cl. ..... 414/800; 414/812
(58) Field of Search ..... 414/800, 812

(56) References Cited

U.S. PATENT DOCUMENTS

| | | | | |
|---|---|---|---|---|
| 4,179,997 A | | 12/1979 | Kirwan | |
| 4,685,399 A | | 8/1987 | Baker | |
| 5,017,064 A | | 5/1991 | Kirwan et al. | |
| 5,107,772 A | | 4/1992 | Viens | |
| 6,089,802 A | * | 7/2000 | Bullock | 410/97 |
| 6,105,525 A | * | 8/2000 | Rapeli | 114/72 |
| 6,123,029 A | | 9/2000 | Mobley | |

FOREIGN PATENT DOCUMENTS

| | | | |
|---|---|---|---|
| AU | 8947250 | * | 6/1990 |
| EP | 338020 | * | 10/1993 |
| EP | 662062 | * | 4/1997 |
| JP | 60124544 | * | 7/1985 |
| JP | 2139381 | * | 5/1990 |
| JP | 72099 | * | 1/1995 |

* cited by examiner

*Primary Examiner*—Steven A. Bratlie
(74) *Attorney, Agent, or Firm*—Stites & Harbison; John E. Vanderburgh

(57) ABSTRACT

A system is provided for the integration of freight transportation from the producers work site to the freight carrier, including any intermediate carriers using carriers adapted for carrying motor vehicles. The system of the invention allows a producer to load a module at the work site, move the module directly from the work site to a vehicle carrier for a return trip, which it would normally make empty, carrying general freight. The present system adapts vehicle carriers for carrying general freight by utilizing a portable module that is carried by the vehicle carrier in substantially the same way as a vehicle to carry general freight. The system of the invention is applicable both to rail vehicle carriers and ships especially adapted for carrying vehicles as well as to over-the-road vehicle carriers. The base of the module is substantially the same length and width as the motor vehicles normally transported by the vehicle carrier and it is provided with at least one set of wheels for portability and for allowing of the module to be loaded onto a vehicle carrier by moving the module onto the carrier with a suitable tractor.

10 Claims, 4 Drawing Sheets

INTERMODAL TRANSPORT SYSTEM FOR FREIGHT

FIELD OF THE INVENTION

This invention relates to a freight distribution system and more particularly to an intermodal transport system utilizing a single module for the intermodal transport of freight, including ship, rail and over-the-road transport.

BACKGROUND OF THE INVENTION

In the shipment of freight it is common for the freight to be carried by different transport means from the shipping point to the destination. Thus, freight will often travel by ship for a part of its journey, be transferred to a rail car for part of the journey and finally transferred to a truck for delivery to the destination. Each change of its transportation mode presents certain problems, not the least of which is the time required to shift the freight to a different mode of transportation such as a rail car and/or truck or truck to a rail car or ship. As a partial solution to this problem the development of container shipping allows individual shippers to load a container at the origination point, normally the factory, that can then be loaded on a truck trailer, rail car or transferred to a ship. The popularity of container shipping has grown to the point where there are now are in operation ships designed solely to carry containers. In a similar fashion vehicles, such as passenger automobiles, pickup trucks, vans and alike are transported from assembly plants to distribution points where they are again shipped to dealers. The vehicles are normally shipped on carriers that are especially adapted for carrying vehicles. Thus for example, wherever possible, vehicles are most economically transported over water, normally using ships that are specially adapted for carrying the vehicles. The vehicles are offloaded from the ship, normally onto rail cars or vehicle trailers for shipment to various distribution points and may be reloaded again for shipment to dealers.

Although these modes of transportation are somewhat efficient, both containers and vehicle carriers must often return empty to their point of origin. On occasion empty containers collect at a port which may create a shortage of containers at points of origin while creating a storage problem at the destination port's. Also, shipping empty containers back to the point of origin adds to the cost of shipping products. Likewise, vehicle carriers, be they ship, rail or truck, normally return empty to their origin points. It has been estimated that vehicle carriers are empty 48% of the time. The cost of returning empty containers and empty vehicle carriers is born by the shipping customer and ultimately by the consumer adding to the cost of goods.

Vehicle carriers are not adapted for carrying general freight, such as, for example, auto parts back to the assembly plant or a mixed load of vehicles and general freight. During periods of slow business cycles in the vehicle industry, the vehicle carriers are under utilized or not utilized at all resulting in substantial costs to the carrier companies and loss of jobs. These factors all produce a cost to the shipper which translates to higher prices for the consumer at the dealer when purchasing a vehicle. Likewise, containers, which are relatively large, are not suited for being transported by vehicle carriers. Vehicle carriers are relatively easy to load and unload while containers present more difficulties in loading and unloading. For example, a containerized ship may require five to six days to unload while a ship that is adapted to carry vehicles can be unloaded in a much shorter period of time.

Several systems have been suggested for inter-modal transportation systems have been suggested in the prior art, for example, U.S. Pat. No. 5,017,064 discloses an intermodal transport system designed for use in the hauling of semi-trailers by means of railway bogies. However, this system requires a turntable and spring loaded chock design to enable efficient loading and unloading of semi-trailers on the bogies.

In yet another inter-modal transport system, U.S. Pat. No. 6,123,029 also relates to a transport system combining trucking and railway technology for the transport of passengers and freight. Essentially this system integrates a highway truck drive system in powered vehicles suited for pulling passenger coaches and highway type trailer containers on rails.

Another system is disclosed in U.S. Pat. No. 5,107,772 that uses a railway bogie incorporating a platform and pivot arm adapted to connect directly to a truck-trailers. The platform is raised by a pneumatic system integrated into the bogie to couple it to the underside of the trailer.

The foregoing systems require the use of additional equipment in order to adapt the truck-trailer for use in a railroad environment. These systems do not address the more efficient use of vehicle carriers nor do these systems address a system for more efficient loading of products on a carrier.

SUMMARY OF THE INVENTION

Accordingly, is an object of the present invention to provide a system for fully utilizing vehicle carriers for transporting general freight as well as vehicles.

Another object of the invention is to provide a system for reducing "dead head" trips by the vehicle carrier.

Yet another object of the invention is to provide a system for integrating the shipment of vehicles and general freight on the same carrier.

Yet still another object of the invention is to provide a system that reduces shipping costs.

The foregoing objects and other objects and advantages of the present invention are achieved by the intermodal system of the present invention.

In accordance with the invention a system is provided for the integration of freight transportation from the producers work site to the freight carrier, including any intermediate carriers. Thus, the system of the invention allows a producer to load a module at the work site, move the module directly from the work site to a suitable carrier, such as a vehicle carrier, for example, that can transport the module to a rail head or dockside for loading on a rail road freight car and/or a ship It is within the scope of the invention to apply the system disclosed herein to aircraft as well.

Although the system of the present invention can be utilized with general freight carriers, such as for example, with conventional truck-trailers, conventional railway freight cars and conventional cargo ships, the system is particularly advantageous and most efficient when used in conjunction with vehicle carriers.

The present system adapts vehicle carriers for carrying general freight by utilizing a portable module that is adapted to be carried by the vehicle carrier in substantially the same way as a vehicle to carry general freight. As mentioned, the system of the invention is applicable both to rail vehicle carriers and ships especially adapted for carrying vehicles as well as to over-the-road vehicle carriers. The base of the module is substantially the same length and width as the motor vehicles normally transported by the vehicle carrier and it is provided with at least one set of wheels for portability and for allowing of the module to be loaded onto a vehicle carrier by moving the container module onto the carrier with a suitable tractor. The vehicle carrier can carry as many container modules as it can carry vehicles. For example, the combined cargo space of an over-the-road vehicle carrier fully loaded with container modules is equivalent to a semi-trailer.

In accordance with one aspect of the invention a vehicle carrier delivers vehicles to a distribution point or to a dealer and then can be re-loaded with modules containing general freight for the return trip to the assembly plant. Such general freight may comprise parts used in the assembly of the vehicles or freight to be delivered to a point in the vicinity of the assembly plant. In this manner the vehicle carrier is utilized to transport a payload on its return trip.

In another aspect of the invention the system can be utilized to deliver parts from a parts distribution point to an assembly plant and make a return trip carrying vehicles assembled at the factory.

In yet another aspect of the invention, the vehicle carrier transports a mixed load of vehicles and modules containing general freight. Thus, both vehicles and parts can be transported from the factory in a single vehicle carrier.

In yet another aspect of the invention the module utilized in the system serves as a shipping palette and, as such, can be positioned in the manufacturing facility for loading directly at the point of manufacture. As thus loaded, the module can then be integrated into the system for shipping the products.

Even under the best of circumstances it may still be necessary to ship empty modules to a loading point. The modules utilized in the present system are collapsible so that when empty and collapsed four modules can be stacked in the space taken by one uncollapsed module.

The system of the invention will be more fully understood from the following detailed description of the invention taken in conjunction with the drawings.

DESCRIPTION OF THE PREFERRED EMBODIMENT

The system will be described herein in connection with a manufacturer or parts depot in which general freight such as, for example, automobile engines, floor mats or similar automobile components are shipped to an assembly point or to a destination in the vicinity of the assembly plant using the motor vehicle carrier which would normally be empty for the return trip.

Figure 1:
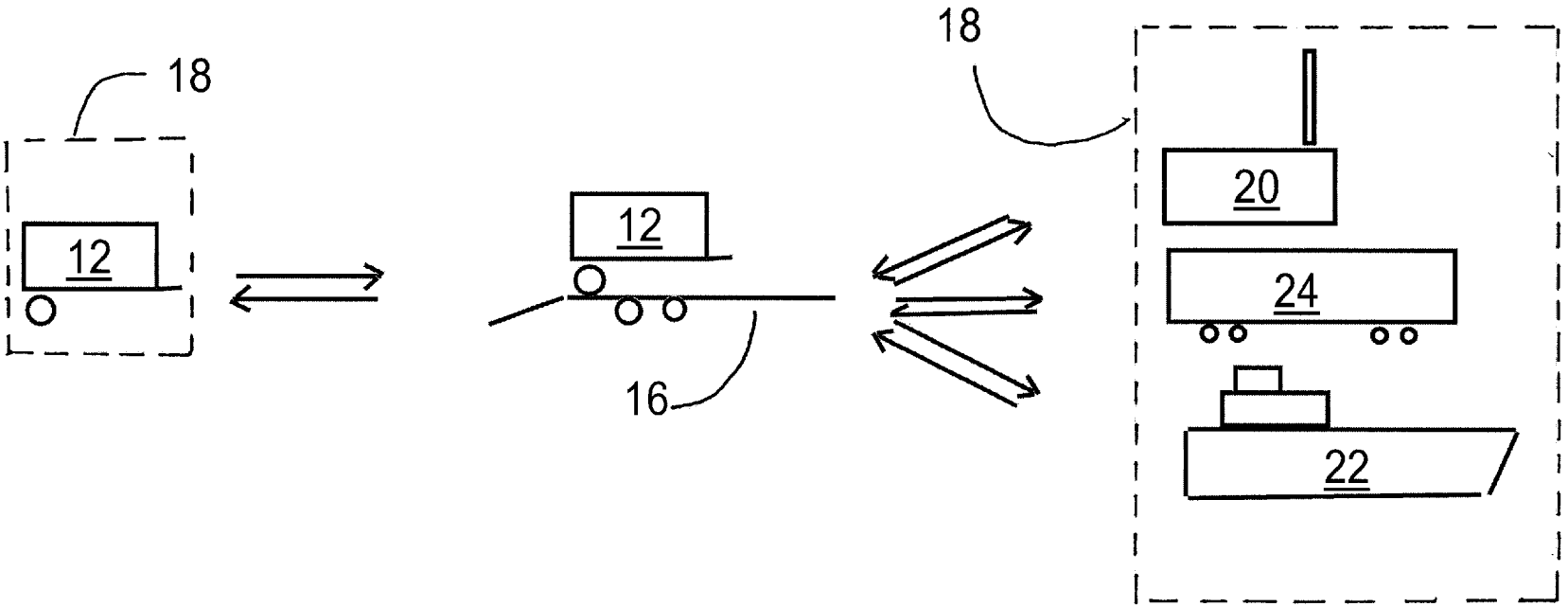
FIG. 1 is a flow diagram illustrating the inter-modal transport system in accordance with the invention.

As illustrated in FIG. 1, the inter-modal transport system begins with the loading of a container module 12 at an initial point 14, which for purposes of description will be a manufacturing facility for automotive components. The container module 12 may be located in the facility at the point where the finished product leaves the manufacturing line so that the product can be directly loaded onto the container. The container module 12 may have removable sides and top for ease of loading.

In the second phase of the system the wheeled container module 12 is moved onto a carrier 16 that is adapted for carrying vehicles. The term "adapted for carrying motor vehicles" means that the carrier 16, be it a tractor/trailer, rail car or ship, is provided with rails onto which the motor vehicles to be carried are driven to load and off load the carrier. Usually the carriers 16 are adapted to carry more than one level of vehicles. Although such carriers 16 are normally initially constructed for this purpose, it will be understood that conventional rail cars, ships and trailers can be modified by providing the necessary rails and ramps to adapt them for carrying motor vehicles.

In the third phase, the container modules 12 are offloaded at an operation point 18 which may be a final operation point, that is the final destination for the cargo, or at an intermediate operation point for reloading on a different form of vehicle transport.

In accordance with the invention the dimensions of the container module 12 are essentially the same as those of passenger cars and small trucks so that the container can be carried by transport means adapted for carrying such vehicles. In this manner the vehicle transport means, i.e. over-the-road transport, rail and ship vehicle can be used to carry other types of cargo and thus many empty runs are avoided. The carrier 16 illustrated in the second phase of the inter-modal transport method is an over-the-road trailer carrying the container modules 12 loaded with product from the initial point 14 to the operation point 18. It will be understood, however, that in the second phase the container modules 12 may be loaded directly onto rail cars 24, as illustrated in FIG. 5, or directly onto a ship 22 for further transport to an over seas operation point. Aircraft may also be adapted for carrying vehicles in which case their ability to carry normal cargo may be diminished or lost altogether. The present invention provides a system which readily converts aircraft configured to carry vehicles into general cargo aircraft.

As used herein the terms "initial point" and "operation point" are used respectively to designate a source from which and a destination to which the modular containers are shipped. For example, the initial point 14 will often be a parts manufacturing facility or a parts depot from which parts are to be shipped. The final operation point 18 may be another manufacturing site or an assembly plant that utilizes the parts carried in the modular containers from the initial point. An intermediate operation point 18 is a transfer point such as a rail head or port where the module containers are transferred to a different transport. In the FIG. 1 the initial point 14 is illustrated by the schematic representation of the container module. The final operation point 18 represented by a schematic rendering of a factory building 20. An intermediate operation point 18 is a transfer point such as a port, as represented by a ship 22 or a rail head, as represented by a railroad car 24, where the container modules 12 are transferred to a ship adapted for auto transport or to rail cars adapted to carry wheeled vehicles. An intermediate operation point 18 also includes a transfer point where the container modules 12 are transferred between carriers of the same type, such as for example, from one tractor/trailer 16 to another tractor/trailer.

Figure 2:
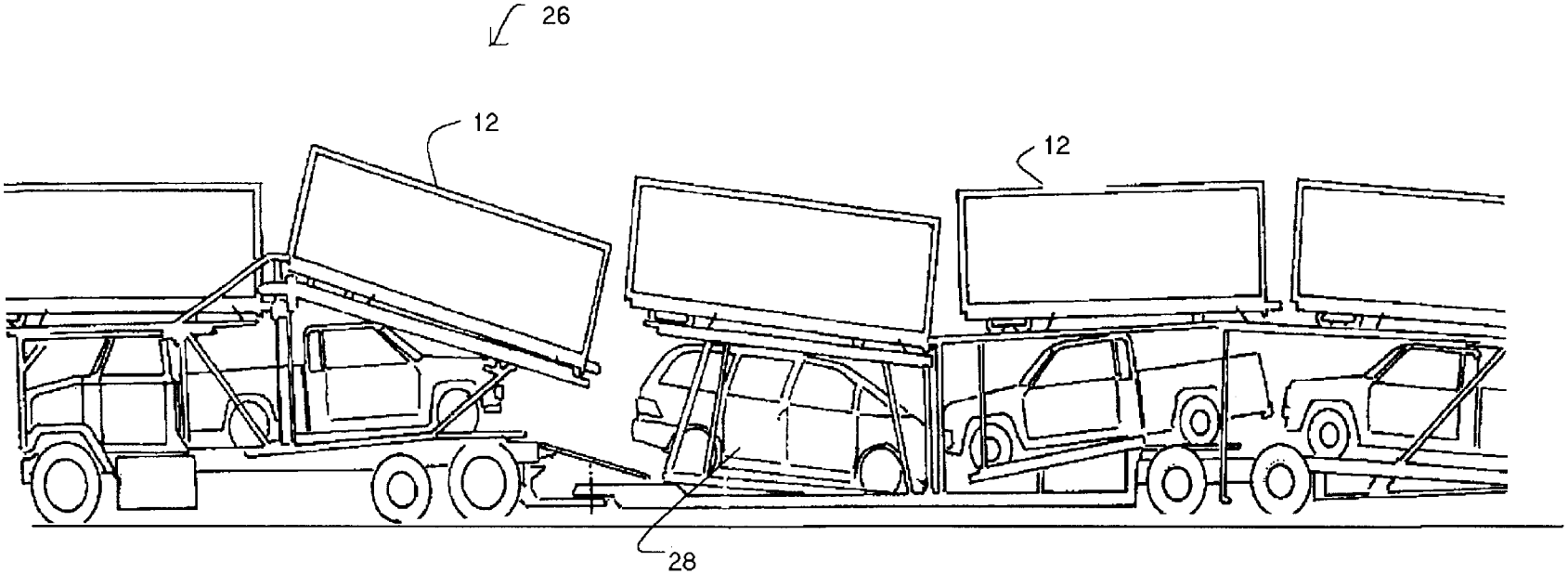
FIG. 2 is a side view of a vehicle carrier loaded with vehicles and with wheeled container modules in accordance with the invention.

FIG. 2 shows a typical over-the-road auto transport tractor/trailer 26. As shown the tractor/trailer, shown generally as 26, is only partially loaded with vehicles 28 and under these circumstances the tractor/trailer would ordinarily transport a partial load of vehicles and return empty to the auto pick-up point. However, as illustrated the upper section of the trailer and the over the cab section of the tractor carry container modules 12 adapted for transport by a vehicle carrier which contain loose freight which ordinarily could not be carried by the tractor/trailer 26. In accordance with the invention, a vehicle carrier, such as the tractor/trailer 26 can deliver vehicles and rather than making the return trip empty can be loaded with the wheeled container modules 12 and carry freight on the return trip. The cost of transporting vehicles can be substantially reduced.

Referring to FIG. 3 and FIGS. 4A–C, the wheeled container module 12 consists essentially of a pallet 30 on which freight is placed. The pallet 30 is supported by a truck comprising a support platform 34, a pair of wheels 36 and a downwardly extending support leg 38. The dimension of the container module 12 is substantially the same length and width as a passenger auto or pickup truck and is provided with at least one set of wheels 36 for portability and for allowing of the module to be loaded onto a vehicle carrier, such as a tractor/trailer 26 by pushing or towing the module onto the carrier with a suitable tug. The support leg 38 may be pivotally attached to the underside of the support platform 34 for folding against the underside of the support platform for stacking and storage of the container module. The lateral spacing between the wheels 36 of the container module 12 is substantially equal to the lateral distance between the wheels of a passenger car, SUV or light truck so that the container module 12 can be easily rolled onto and off of the support tracks of the vehicle carrier during loading and unloading of the container module on the carrier. Loading and unloading is facilitated by the use of a tug or a fork lift truck of the type normally found at industrial sites. A towing pintle 32 is provided for attaching a tug or tractor to the container module 12.

Figure 3:
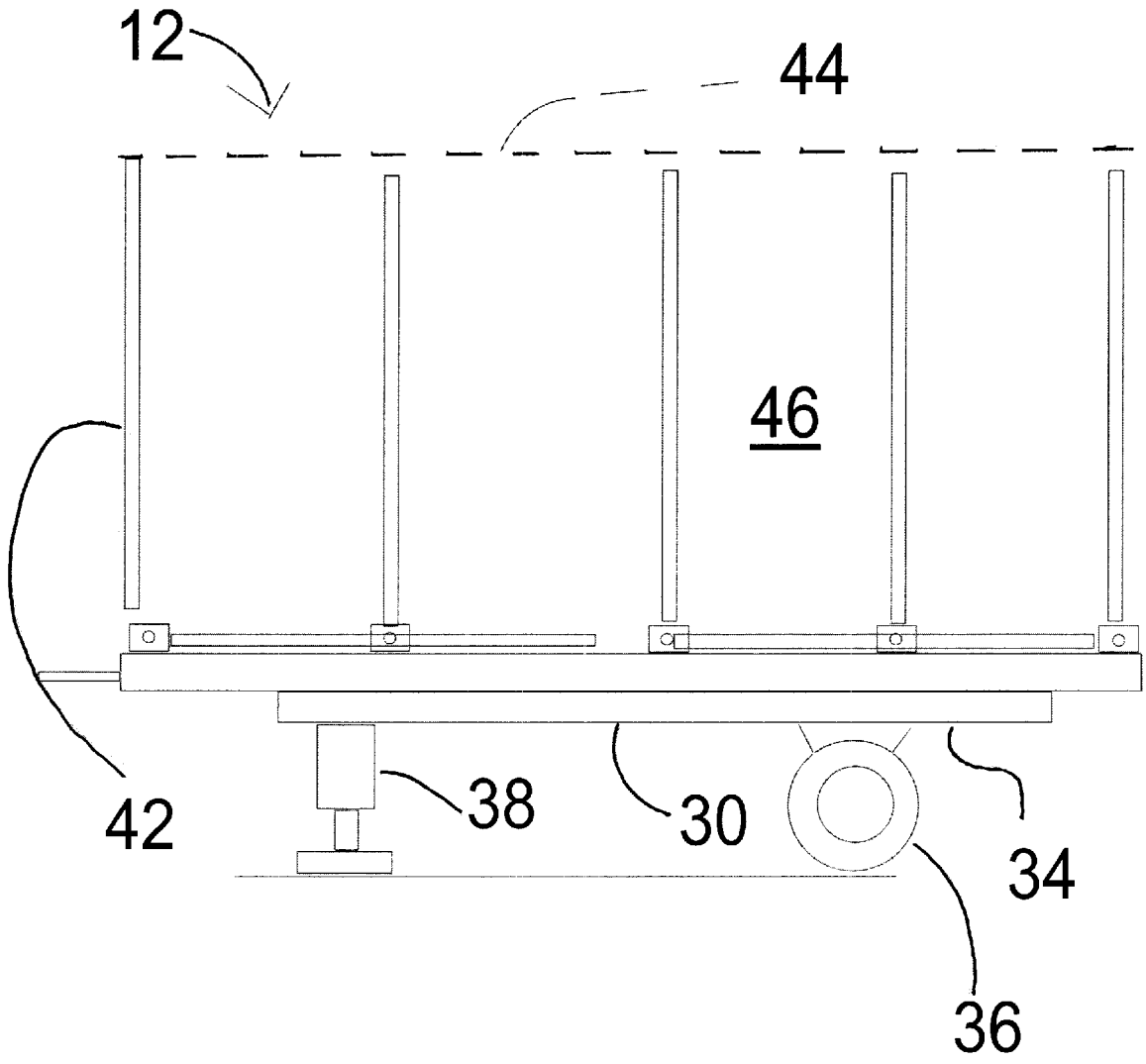
FIG. 3 is the side elevation of a wheeled container module.
Figure 4A:
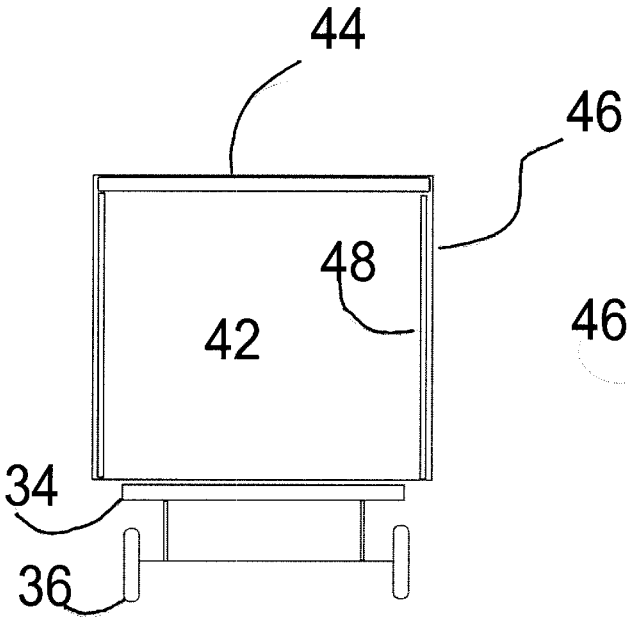
FIG. 4A is an end elevation of the container module of FIG. 3.

As shown in FIG. 3 and FIG. 4A, the upper surface of the pallet 30 is preferably enclosed by a collapsible cover comprising a front and rear end walls 42, a top 44 and a pair of side walls 46 that cooperate with the pallet 30 to define the cargo area of the container module 12. The side walls are reinforced by ribs 48 that are pivotally mounted on the pallet 30 for folding into a horizontal position of the pallet. Suitable locking means are provided to lock the ribs in their upright position and for unlocking the ribs for folding. The cover is formed from a flexible material, preferably two layers of canvas with a flexible reinforcing mesh disposed between the layers of material. Flexible materials of this type are well known in the art and do not per se form a part of the invention.

Figure 4B:
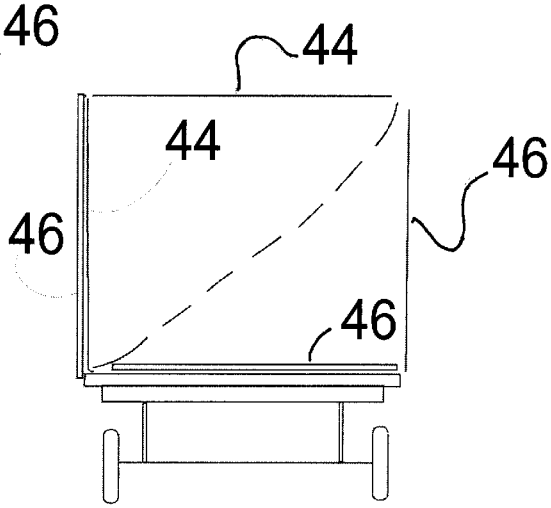
FIG. 4B illustrates the container module of FIG. 4A with the cover partially folded.
Figure 4C:
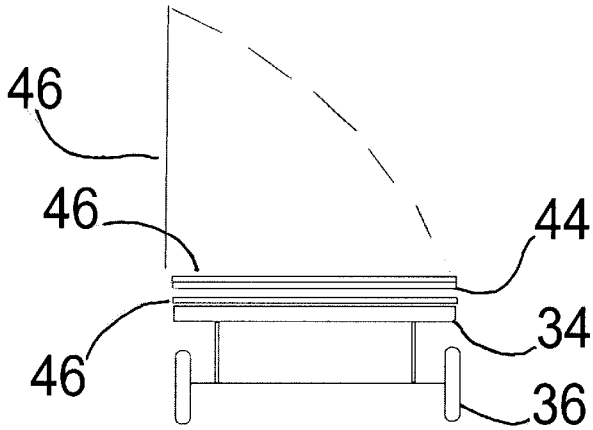
FIG. 4C illustrates the container module of FIG. 4A with the cover completely folded.

The collapsible cover can be folded for stacking or storage of the container module 12 by rolling or folding the end walls 42 against the underside of the top 44. One side wall 46 is pivoted onto the surface of the pallet 30 which causes the top 44 and the folded or rolled end walls 42 to lie vertically against the standing side wall (FIG. 4B). The standing side wall 46 is then pivoted into a horizontal position over the first side wall with the top 44 and the end walls 42 sandwiched between the side walls. The cover is unfolded in the opposite manner. The support leg 38 may also be pivoted up against the underside of the truck of the container module. When thus folded 4 or 5 container modules 12 may be stacked in the space occupied by a passenger automobile thus allowing a number of modules to be shipped on a vehicle carrier 16 when being returned empty to an initial point 14 for reloading.

Although it is preferred that the cover of the container module 12 be able to be folded for ease of shipping and storage, it will be understood that other types of covers may be preferred for certain types of freight. For example, the cover may be vacuum formed to define a non-collapsible container that provides additional protection against minor impacts, weather conditions and the like that may be encountered during shipping. The container may also be formed by assembling panels to define the top, end and side walls of the container and disassembling and removing the panels from the pallet 30 for stacking the container module 12 for shipping or storage.

In operation the intermodal system of the invention is designed for the transfer of freight from an initial point 14 where the freight is originated to an operation point 18 which is the destination for the freight using vehicle carriers as the means for transporting the freight. It should be clear that the system is particularly designed for efficient transfer between various vehicle carriers en route to the operation point. For example, one or more container modules 12 are loaded with auto parts, such as automobile engines, at the initial point, an engine manufacturing facility for shipment to an operation point, an automobile assembly plant. Using a suitable tug, the loaded container modules 12 are moved onto a vehicle carrier 16 such as an over-the-road vehicle carrier or onto a rail car adapted to carry vehicles. Normally the vehicle carriers will have delivered vehicles to dealers or distribution points in the local area and would otherwise be returned empty to a vehicle distribution point or the vehicle assembly plant. By the intermodal system the vehicle carrier 16 is reloaded with container modules 12 for shipment of auto engines back to the assembly plant thus avoiding "dead heading" which substantially increases the delivery cost of vehicles. In this example the automobile assembly plant is located at an offshore site and the container modules 12 are shipped to a destination port for loading on a ship which has delivered vehicles. Thus the ship is utilized to deliver parts to the assembly plant for assembly into vehicles that are shipped back to the port. It is apparent that by avoiding having the ship return empty to reload with vehicles substantially reduces the cost of delivering vehicles to the destination port. In addition the turn around time for offloading and reloading the ship with container modules 12 is substantially reduced from the five to six days required to offload a container ship.

As will be understood by those skilled in the art, various arrangements which lie within the spirit and scope of the invention other than those described in detail in the specification will occur to those persons skilled in the art. It is therefor to be understood that the invention is to be limited only by the claims appended hereto.

Having defined the invention I claim:

1. A method for the integration of freight transportation by inter-modal transportation of general freight by a carrier adapted for transporting wheeled motor vehicles, said method comprising:

a. providing one or more wheeled container modules adapted to be carried by said carrier in the same manner as motor vehicles normally transported by said carrier;

b. loading general freight into said wheeled container modules at an initial point;

c. moving loaded wheeled container modules onto said carrier in essentially the same manner as motor vehicles are loaded thereon;

d. transporting said container modules by said carrier to a final operation point; and e. off loading said container modules for utilization of the general freight contained therein.

2. The method of claim 1 further including the step of transporting said container modules to one or more intermediate operation points prior to said final operation point.

3. The method of claim 2 wherein an intermediate operation point is a transfer point for transferring said container modules from a first transport to a second transport.

4. The method of claim 3 wherein said first transport and said second transport are particularly adapted to carry motor vehicles and are carriers of the type consisting of over-the-road carriers, rail cars and ships and said first transport is a different type than said second transport.

5. The method of claim 1 wherein said carrier has delivered motor vehicles to a delivery point and would normally return empty to its origin for pick up of motor vehicles, said carrier receiving one or more container modules at an initial point near the delivery point for the transport of general freight to an operation point near the origin thereby eliminating a return trip without a load.

6. The method of claim 5 wherein the origin of the carrier is a vehicle assembly plant and the initial point of the container modules is a parts manufacturing site for parts utilized by the vehicle assembly plant.

7. The method of claim 1 wherein motor vehicles are delivered from an assembly plant to a origin port for transport by ship to a destination port, at said destination port said motor vehicles are off loaded from said ship onto an overland carrier adapted for carrying motor vehicles, said overland carrier being selected from the group consisting of rail cars, tractor/trailers and combinations thereof for transportation to a delivery point at or near an initial point, moving said overland carrier to said initial point for receiving container modules loaded with general freight for shipment to the destination port, transferring said container modules onto said ship for transport to the origin port whereby both said ship and said overland carrier transport freight on the return trip.

8. The method of claim 1 wherein said container module comprises a pallet for carrying freight, a truck supporting said pallet, said truck comprising a support platform and at least a pair of wheels secured thereto, the lateral spacing between the wheels of said pair being substantially equal to the lateral distance between the wheels of a passenger car, SUV or light truck so that the container module can be easily rolled onto and off of the support tracks of the vehicle carrier during loading and unloading of the container module.

9. The method of claim 8 wherein said container module further includes a cover for enclosing said pallet.

10. The method of claim 9 wherein said cover is collapsible to lie on said pallet for stacking said container module for shipping or storage.

* * * * *